US012601098B2

(12) United States Patent
Castillo et al.

(10) Patent No.: US 12,601,098 B2
(45) Date of Patent: Apr. 14, 2026

(54) WASHING MACHINE APPLIANCE TUB COVER

(71) Applicant: Haier US Appliance Solutions, Inc., Wilmington, DE (US)

(72) Inventors: Jose Francisco Castillo, Louisville, KY (US); James Quentin Pollett, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 42 days.

(21) Appl. No.: 18/756,826

(22) Filed: Jun. 27, 2024

(65) Prior Publication Data

US 2026/0002310 A1 Jan. 1, 2026

(51) Int. Cl.

| | |
|---|---|
| ***D06F 37/26*** | (2006.01) |
| ***D06F 23/04*** | (2006.01) |
| ***D06F 37/12*** | (2006.01) |

(52) U.S. Cl.

CPC ..... *D06F 37/26* (2013.01); *D06F 23/04* (2013.01); *D06F 37/12* (2013.01)

(58) Field of Classification Search

CPC ..... D06F 37/26

See application file for complete search history.

(56) References Cited

U.S. PATENT DOCUMENTS

| | | | |
|---|---|---|---|
| 11,873,600 | B2 | 1/2024 | Holzen et al. |
| 2021/0032794 | A1 | 2/2021 | Strait |
| 2022/0349101 | A1 | 11/2022 | Kehl |
| 2023/0059400 | A1 | 2/2023 | Damtew et al. |

FOREIGN PATENT DOCUMENTS

| | | | |
|---|---|---|---|
| CN | 108252029 | A | 7/2018 |
| CN | 110409148 | A | 11/2019 |
| KR | 100336393 | B1 | 5/2002 |

OTHER PUBLICATIONS

Whirlpool Washer WTW5057LWO Tub Ring W11513258 W11352092 AP7014019 PS16543461, accessed https://www.ebay.com/itm/165870631861 on Jun. 27, 2024, 6 pages.

*Primary Examiner* — Jason Y Ko

(74) *Attorney, Agent, or Firm* — Dority & Manning, P.A.

(57) ABSTRACT

A washing machine appliance includes a cabinet, a wash tub positioned within the cabinet, a wash basket rotatably mounted within the wash tub and defining a wash chamber for receiving a load of clothes, and a tub cover positioned over the wash tub. Rotation of the wash basket within the wash tub circulates a flow of air within the wash tub. The tub cover includes a main body including an edge defining a perimeter of the main body. The main body includes a top surface and a sloped surface connecting the top surface and the edge and defining a slope. Additionally, a plurality of top surface openings are defined through the top surface. Furthermore, a plurality of sloped surface openings are defined through the sloped surface for facilitating the flow of air into and out of the wash basket.

20 Claims, 8 Drawing Sheets

WASHING MACHINE APPLIANCE TUB COVER

FIELD OF THE INVENTION

The present subject matter relates generally to washing machine appliances, or more specifically, to a tub cover for a washing machine appliance.

BACKGROUND OF THE INVENTION

Washing machine appliances generally include a cabinet that receives a tub for containing wash and rinse water. A wash basket is rotatably mounted within the tub. A drive assembly is coupled to the tub and configured to rotate the wash basket within the tub to cleanse articles within the wash basket. Upon completion of a wash cycle, a pump assembly can be used to rinse and drain soiled water to a draining system. Some washing machine appliances may also rotate the wash basket at a relatively high speed for a spin cycle to further drain or shed water from articles within the wash basket.

Washing machine appliances are typically only able to remove limited amounts of water and moisture from the articles within the wash basket after the wash cycle is completed. As such, there is often a remaining moisture content in the washed articles at the end of the wash cycle. The remaining moisture content often leads to energy inefficiencies of washing machine appliances. For example, washing machine appliances may require more energy/power to rotate the wash basket during a spin cycle the higher the remaining moisture content. Energy inefficiencies of washing machine appliances may lead to higher energy costs. Furthermore, stricter federal energy regulations necessitate reducing the remaining moisture content after the wash cycle.

Accordingly, a washing machine appliance that reduces the amount of remaining moisture content within the wash basket is desirable. More specifically, a tub cover that increases airflow through the wash basket would be particularly beneficial.

BRIEF DESCRIPTION OF THE INVENTION

Advantages of the invention will be set forth in part in the following description, or may be apparent from the description, or may be learned through practice of the invention.

In one exemplary embodiment, a washing machine appliance is provided. The washing machine appliance includes a cabinet, a wash tub positioned within the cabinet, a wash basket rotatably mounted within the wash tub and defining a wash chamber configured for receiving a load of clothes, and a tub cover positioned over the wash tub. The tube cover includes a main body including an edge defining a perimeter of the main body. The main body also includes a top surface and a sloped surface connecting the top surface and the edge and defining a slope. Additionally, rotation of the wash basket within the wash tub circulates a flow of air within the was tub. Furthermore, a plurality of top surface openings are defined through the top surface of the main body of the tub cover. Moreover, a plurality of sloped surface openings are defined through the sloped surface of the main body of the tub cover for facilitating the flow of air circulated by rotation of the wash basket into and out of the wash basket.

In another exemplary embodiment, a tub cover for a washing machine appliance is provided. The washing machine appliance includes a cabinet, a wash tub positioned within the cabinet, and a wash basket rotatably mounted within the wash tub and defining a wash chamber configured for receiving a load of clothes. The tub cover includes a main body including an edge defining a perimeter of the main body. The main body also includes a top surface and a sloped surface connecting the top surface and the edge and defining a slope. Additionally, rotation of the wash basket within the wash tub circulates a flow of air within the wash tub. Furthermore, a plurality of surface openings are defined through the main body of the tub cover for facilitating the flow of air circulated by rotation of the wash basket into and out of the wash basket.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
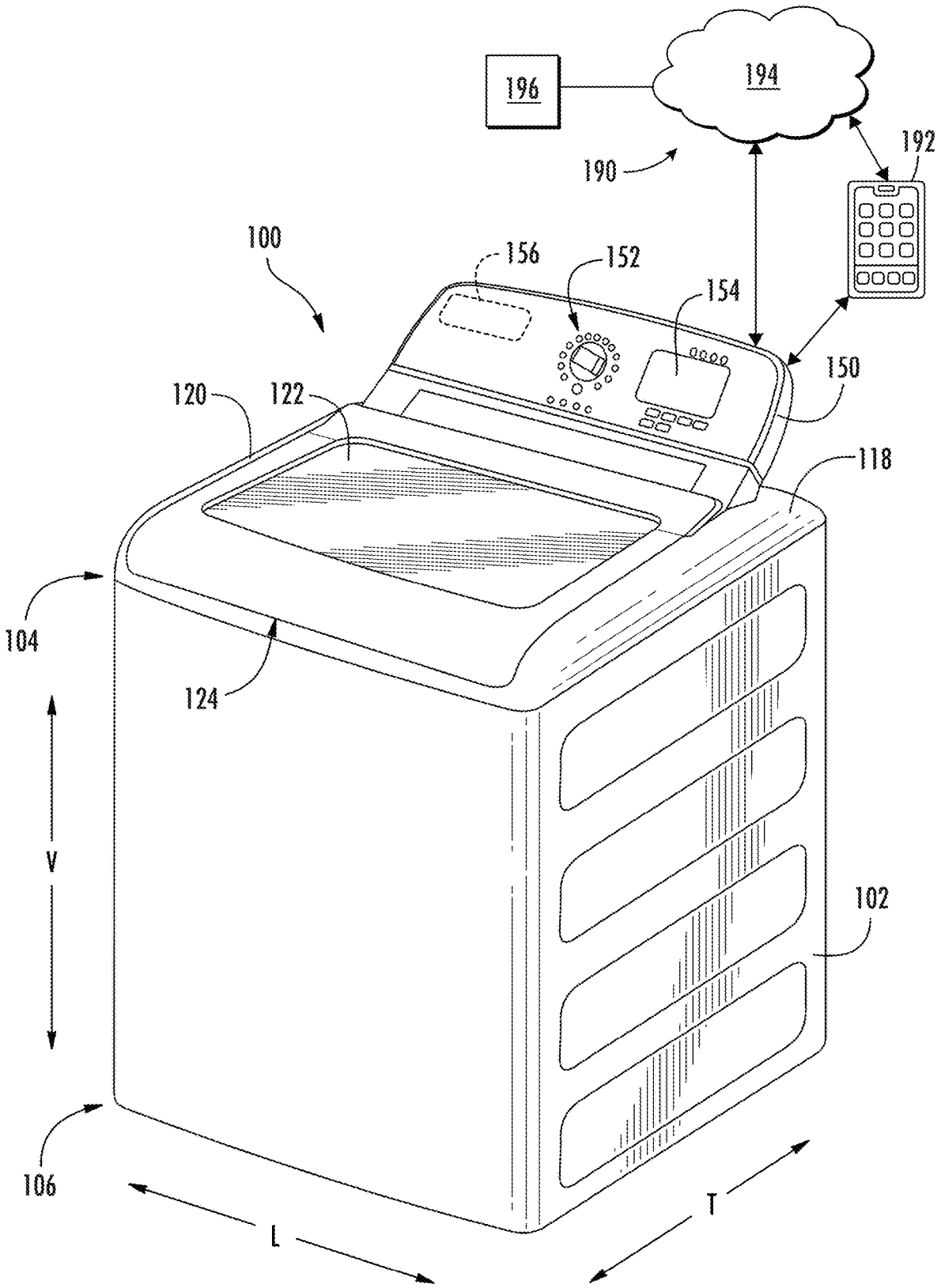
FIG. 1 provides a perspective view of a washing machine appliance according to an exemplary embodiment of the present subject matter with a door of the exemplary washing machine appliance shown in a closed position.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
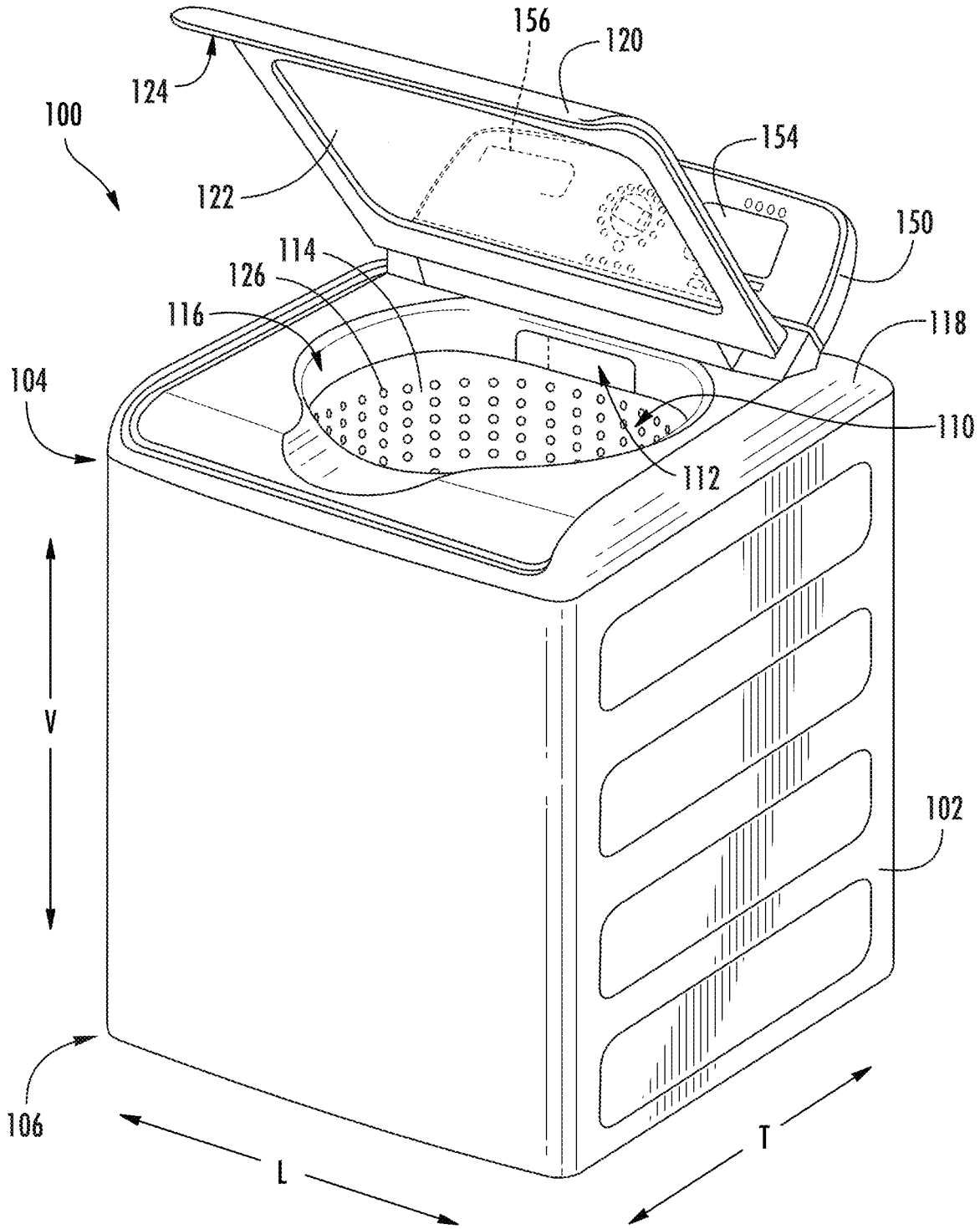
FIG. 2 provides a perspective view of the exemplary washing machine appliance of FIG. 1 with the door of the exemplary washing machine appliance shown in an open position.
Figure 3:
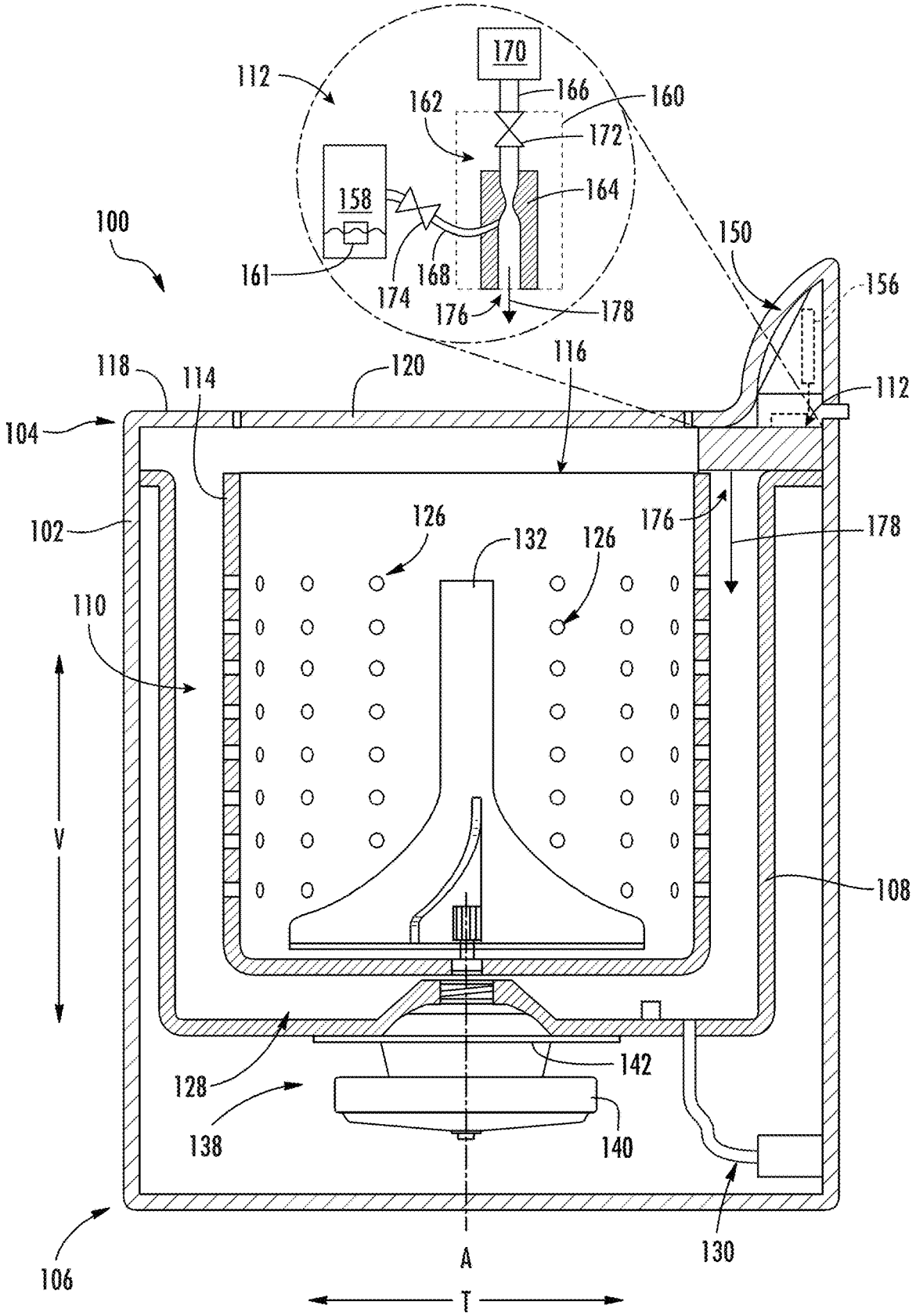
FIG. 3 provides a side cross-sectional view of the exemplary washing machine appliance of FIG. 1.
Figure 4:
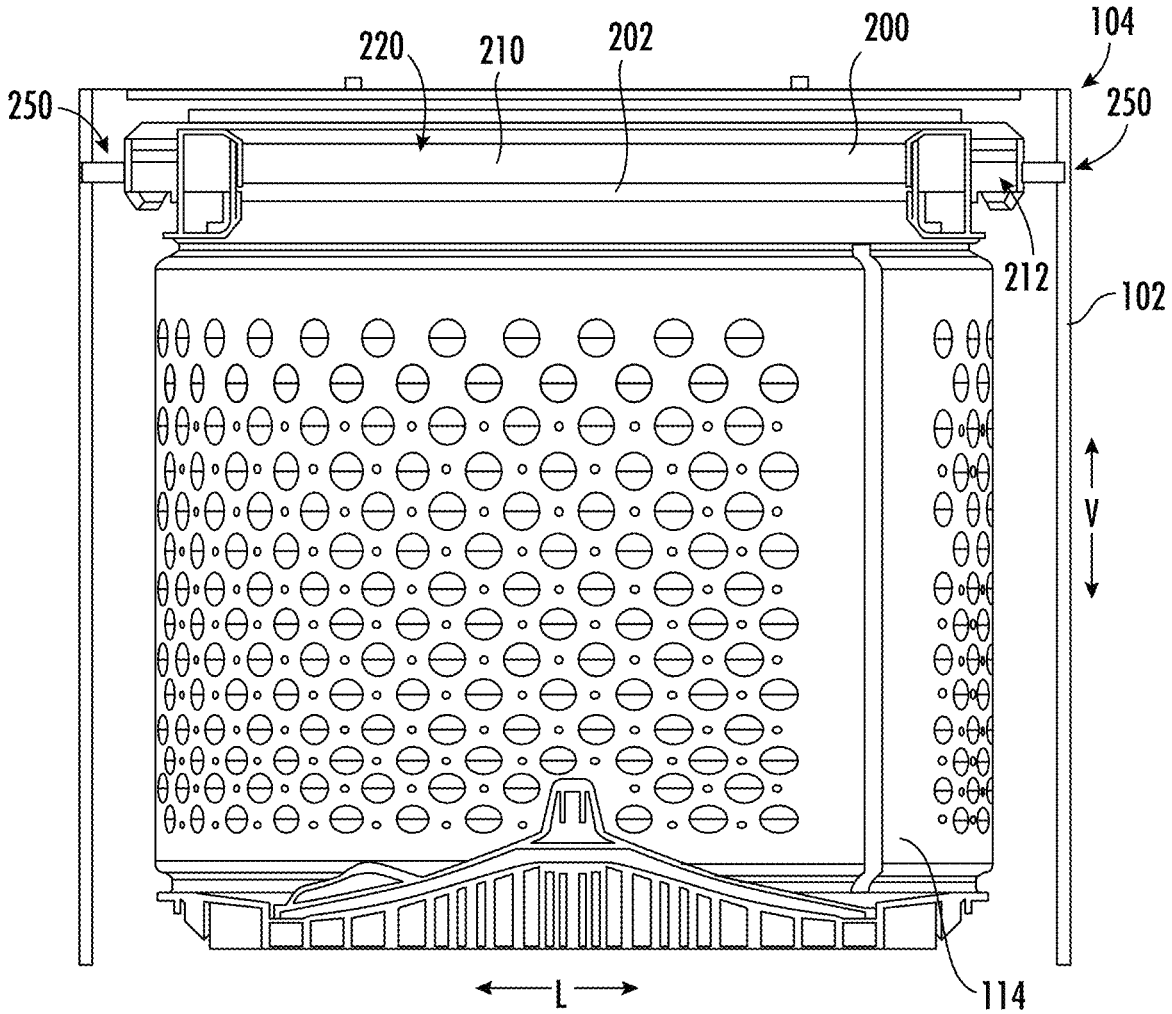
FIG. 4 provides a cross-sectional side view of a tub assembly of the exemplary washing machine appliance of FIG. 1 in accordance with one embodiment of the present disclosure.
Figure 5:
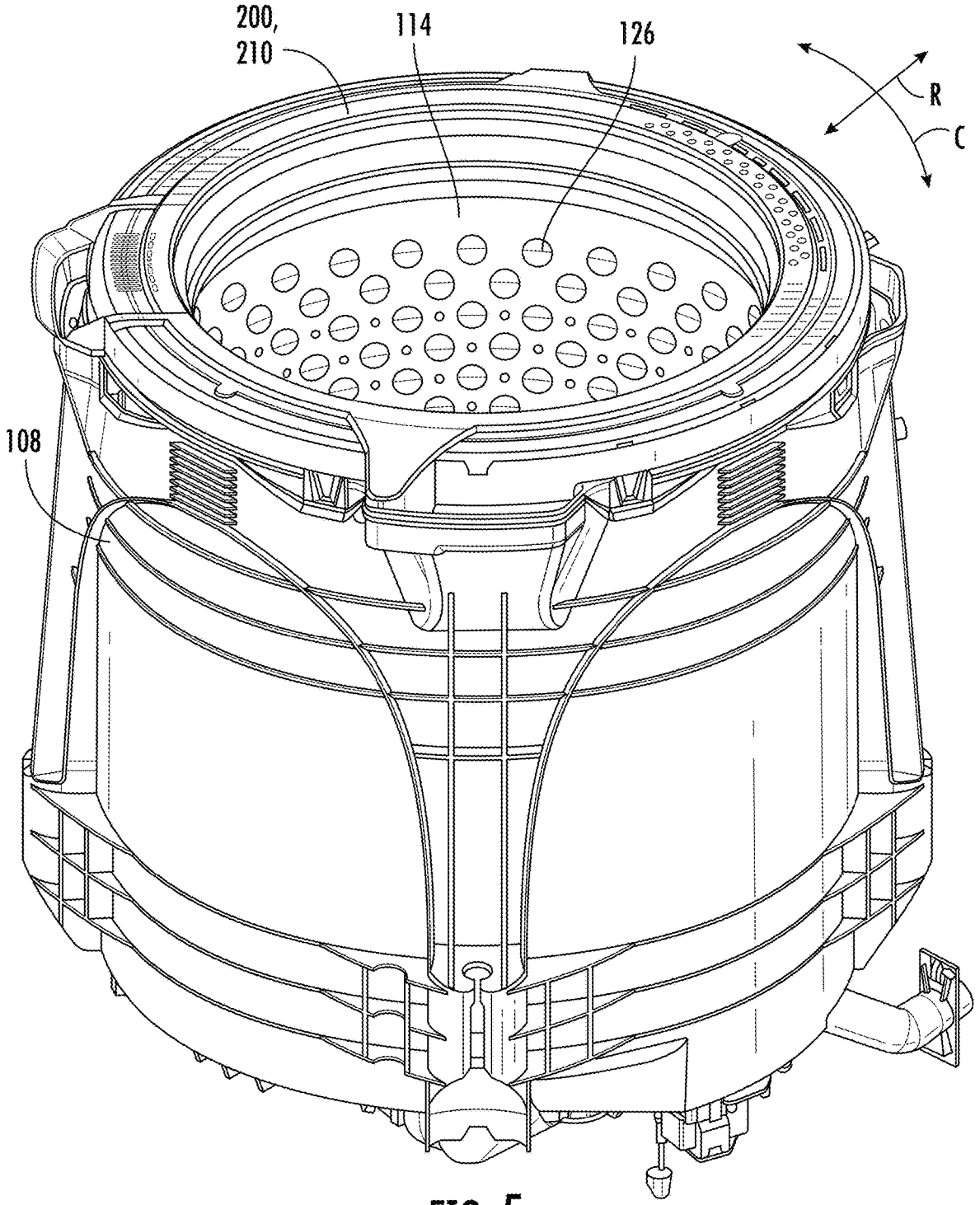
FIG. 5 provides a perspective view of a tub assembly of the exemplary washing machine appliance of FIG. 1 in accordance with one embodiment of the present disclosure.

FIGS. 1 through 3 illustrate an exemplary embodiment of a vertical axis washing machine appliance 100. Specifically, FIGS. 1 and 2 illustrate perspective views of washing machine appliance 100 in a closed and an open position, respectively. FIG. 3 provides a side cross-sectional view of washing machine appliance 100. Washing machine appliance 100 generally defines a vertical direction V, a lateral direction L, and a transverse direction T, each of which is mutually perpendicular, such that an orthogonal coordinate system is generally defined.

While described in the context of a specific embodiment of vertical axis washing machine appliance 100, it should be appreciated that vertical axis washing machine appliance 100 is provided by way of example only. It will be understood that aspects of the present subject matter may be used in any other suitable washing machine appliance, such as a horizontal axis washing machine appliance. Indeed, modifications and variations may be made to washing machine appliance 100, including different configurations, different appearances, and/or different features while remaining within the scope of the present subject matter.

Washing machine appliance 100 has a cabinet 102 that extends between a top portion 104 and a bottom portion 106 along the vertical direction V, between a first side (left) and a second side (right) along the lateral direction L, and between a front and a rear along the transverse direction T. As best shown in FIG. 3, a wash tub 108 is positioned within cabinet 102, defines a wash chamber 110, and is generally configured for retaining wash fluids during an operating cycle. Washing machine appliance 100 further includes a primary dispenser or dispensing assembly 112 (FIG. 2) for dispensing wash fluid into wash tub 108.

In addition, washing machine appliance 100 includes a wash basket 114 that is positioned within wash tub 108 and generally defines an opening 116 for receipt of articles for washing. More specifically, wash basket 114 is rotatably mounted within wash tub 108 such that it is rotatable about an axis of rotation A. According to the illustrated embodiment, the axis of rotation A is substantially parallel to the vertical direction V. In this regard, washing machine appliance 100 is generally referred to as a "vertical axis" or "top load" washing machine appliance 100. However, it should be appreciated that aspects of the present subject matter may be used within the context of a horizontal axis or front load washing machine appliance as well.

As illustrated, cabinet 102 of washing machine appliance 100 has a top panel 118. Top panel 118 defines an opening (FIG. 2) that coincides with opening 116 of wash basket 114 to permit a user access to wash basket 114. Washing machine appliance 100 further includes a door 120 which is rotatably mounted to top panel 118 to permit selective access to opening 116. In particular, door 120 selectively rotates between the closed position (as shown in FIGS. 1 and 3) and the open position (as shown in FIG. 2). In the closed position, door 120 inhibits access to wash basket 114. Conversely, in the open position, a user can access wash basket 114. A window 122 in door 120 permits viewing of wash basket 114 when door 120 is in the closed position, e.g., during operation of washing machine appliance 100. Door 120 also includes a handle 124 that, e.g., a user may pull and/or lift when opening and closing door 120. Further, although door 120 is illustrated as mounted to top panel 118, door 120 may alternatively be mounted to cabinet 102 or any other suitable support.

As best shown in FIGS. 2 and 3, wash basket 114 further defines a plurality of perforations 126 to facilitate fluid communication between an interior of wash basket 114 and wash tub 108. In this regard, wash basket 114 is spaced apart from wash tub 108 to define a space for wash fluid to escape wash chamber 110. During a spin cycle, wash fluid within articles of clothing and within wash chamber 110 is urged through perforations 126 wherein it may collect in a sump 128 defined by wash tub 108. Washing machine appliance 100 further includes a pump assembly 130 (FIG. 3) that is located beneath wash tub 108 and wash basket 114 for gravity assisted flow when draining wash tub 108.

An impeller or agitation element 132 (FIG. 3), such as a vane agitator, impeller, auger, oscillatory basket mechanism, or some combination thereof is disposed in wash basket 114 to impart an oscillatory motion to articles and liquid in wash basket 114. More specifically, agitation element 132 extends into wash basket 114 and assists agitation of articles disposed within wash basket 114 during operation of washing machine appliance 100, e.g., to facilitate improved cleaning. In different embodiments, agitation element 132 includes a single action element (i.e., oscillatory only), a double action element (oscillatory movement at one end, single direction rotation at the other end) or a triple action element (oscillatory movement plus single direction rotation at one end, single direction rotation at the other end). As illustrated in FIG. 3, agitation element 132 and wash basket 114 are oriented to rotate about axis of rotation A (which is substantially parallel to vertical direction V).

As best illustrated in FIG. 3, washing machine appliance 100 includes a drive assembly or motor assembly 138 in mechanical communication with wash basket 114 to selectively rotate wash basket 114 (e.g., during an agitation or a rinse cycle of washing machine appliance 100). In addition, motor assembly 138 may also be in mechanical communication with agitation element 132. In this manner, motor assembly 138 may be configured for selectively rotating or oscillating wash basket 114 and/or agitation element 132 during various operating cycles of washing machine appliance 100.

More specifically, motor assembly 138 may generally include one or more of a drive motor 140 and a transmission assembly 142, e.g., such as a clutch assembly, for engaging and disengaging wash basket 114 and/or agitation element 132. According to the illustrated embodiment, drive motor 140 is a brushless DC electric motor, e.g., a pancake motor. However, according to alternative embodiments, drive motor 140 may be any other suitable type or configuration of motor. For example, drive motor 140 may be an AC motor, an induction motor, a permanent magnet synchronous motor, or any other suitable type of motor. In addition, motor assembly 138 may include any other suitable number, types, and configurations of support bearings or drive mechanisms.

Referring still to FIGS. 1 through 3, a control panel 150 with at least one input selector 152 (FIG. 1) extends from top panel 118. Control panel 150 and input selector 152 collectively form a user interface input for operator selection of machine cycles and features. A display 154 of control panel 150 indicates selected features, operation mode, a countdown timer, and/or other items of interest to appliance users regarding operation.

Operation of washing machine appliance 100 is controlled by a controller or processing device 156 that is operatively coupled to control panel 150 for user manipulation to select washing machine cycles and features. In response to user manipulation of control panel 150, controller 156 operates the various components of washing machine appliance 100 to execute selected machine cycles and features. According to an exemplary embodiment, controller 156 may include a memory and microprocessor, such as a general or special purpose microprocessor operable to execute programming instructions or micro-control code associated with methods described herein. Alternatively, controller 156 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 150 and other components of washing machine appliance 100 may be in communication with controller 156 via one or more signal lines or shared communication buses.

During operation of washing machine appliance 100, laundry items are loaded into wash basket 114 through opening 116, and washing operation is initiated through operator manipulation of input selectors 152. Wash basket 114 is filled with water and detergent and/or other fluid additives via primary dispenser 112. One or more valves can be controlled by washing machine appliance 100 to provide for filling wash tub 108 and wash basket 114 to the appropriate level for the amount of articles being washed and/or rinsed. By way of example for a wash mode, once wash basket 114 is properly filled with fluid, the contents of wash basket 114 can be agitated (e.g., with agitation element 132 as discussed previously) for washing of laundry items in wash basket 114.

Referring again to FIGS. 2 and 3, dispensing assembly 112 of washing machine appliance 100 will be described in more detail. As explained briefly above, dispensing assembly 112 may generally be configured to dispense wash fluid to facilitate one or more operating cycles or phases of an operating cycle (e.g., such as a wash cycle or a rinse cycle). The terms "wash fluid" and the like may be used herein to generally refer to a liquid used for washing and/or rinsing clothing or other articles. For example, the wash fluid is typically made up of water that may include other additives such as detergent, fabric softener, bleach, or other suitable treatments (including combinations thereof). More specifically, the wash fluid for a wash cycle may be a mixture of water, detergent, and/or other additives, while the wash fluid for a rinse cycle may be water only.

As best shown schematically in FIG. 3, dispensing assembly 112 may generally include a bulk storage tank or bulk reservoir 158 and a dispenser box 160. More specifically, bulk reservoir 158 may be positioned under top panel 118 and defines an additive reservoir for receiving and storing wash additive. More specifically, according to the illustrated embodiment, bulk reservoir 158 may contain a bulk volume of wash additive (such as detergent or other suitable wash additives) that is sufficient for a plurality of wash cycles of washing machine appliance 100, such as no less than twenty wash cycles, no less than fifty wash cycles, etc. As a particular example, bulk reservoir 158 is configured for containing no less than twenty fluid ounces, no less than three-quarters of a gallon, or about one gallon of wash additive.

Referring still to FIG. 3, washing machine appliance 100 may further include a one or more tank level sensors 161 that are generally configured for measuring a level or levels of wash additive within bulk reservoir 158. In this regard, for example, tank level sensors 161 may be positioned at multiple heights within bulk reservoir 158 and may be triggered when the level of wash additive falls below a predetermined height (e.g., associated with a specific wash additive volume). For example, washing machine appliance 100 may include tank level sensors 161 that indicate when the level of wash additive is full, low, empty, etc. It should be appreciated that tank level sensors 161 may utilize any suitable technology for measuring fluid levels, e.g., such as float sensors, conductivity sensors, capacitive sensors, mechanical switches, or any other suitable device or technology.

As will be described in detail below, dispensing assembly 112 may include features for drawing wash additive from bulk reservoir 158 and mixing it with water prior to directing the mixture into wash tub 108 to facilitate a cleaning operation. By contrast, dispensing assembly 112 is also capable of dispensing water only. Thus, dispensing assembly 112 may automatically dispense the desired amount of water with or without a desired amount of wash additive such that a user can avoid filling dispenser box 160 with detergent before each operation of washing machine appliance 100.

For example, as best shown in FIG. 3, washing machine appliance 100 includes an aspirator assembly 162, which is a Venturi-based dispensing system that uses a flow of water to create suction within a Venturi tube to draw in wash additive from bulk reservoir 158 which mixes with the water and is dispensed into wash tub 108 as a concentrated wash fluid preferably having a target volume of wash additive. After the target volume of wash additive is dispensed into wash tub 108, additional water may be provided into wash tub 108 as needed to fill to the desired wash volume. It should be appreciated that the target volume may be pre-programmed in controller 156 according to the selected operating cycle or parameters, may be set by a user, or may be determined in any other suitable manner.

As illustrated, aspirator assembly 162 includes a Venturi pump 164 that is fluidly coupled to both a water supply conduit 166 and a suction line 168. As illustrated, water supply conduit 166 may provide fluid communication between a water supply source 170 (such as a municipal water supply) and a water inlet of Venturi pump 164. In addition, washing machine appliance 100 includes a water fill valve or water control valve 172 which is operably coupled to water supply conduit 166 and is communicatively coupled to controller 156. In this manner, controller 156 may regulate the operation of water control valve 172 to regulate the amount of water that passes through aspirator assembly 162 and into wash tub 108.

In addition, suction line 168 may provide fluid communication between bulk reservoir 158 and Venturi pump 164 (e.g., via a suction port defined on Venturi pump 164). Notably, as a flow of water is supplied through Venturi pump 164 to wash tub 108, the flowing water creates a negative pressure within suction line 168. This negative pressure may draw in wash additive from bulk reservoir 158. When certain conditions exist, the amount of wash additive dispensed is roughly proportional to the amount of time water is flowing through Venturi pump 164.

Referring still to FIG. 3, aspirator assembly 162 may further include a suction valve 174 that is operably coupled to suction line 168 to control the flow of wash additive through suction line 168 when desired. For example, suction valve 174 may be a solenoid valve that is communicatively coupled with controller 156. Controller 156 may selectively open and close suction valve 174 to allow wash additive to flow from bulk reservoir 158 through additive suction valve 174. For example, during a rinse cycle where only water is desired, suction valve 174 may be closed to prevent wash additives from being dispensed through suction valve 174. In some embodiments, suction valve 174 is selectively controlled based on at least one of the selected wash cycle, the soil level of the articles to be washed, and the article type. According to still other embodiments, no suction valve 174 is needed at all and alternative means for preventing the flow of wash additive may be used or other water regulating valves may be used to provide water into wash tub 108.

Washing machine appliance 100, or more particularly, dispensing assembly 112, generally includes a discharge nozzle 176 for directing a flow of wash fluid (e.g., identified herein generally by reference numeral 178) into wash chamber 108. In this regard, discharge nozzle 176 may be positioned above wash tub proximate a rear of opening 116 defined through top panel 118. Dispensing assembly 112 may be regulated by controller 156 to discharge wash fluid 178 through discharge nozzle 176 at the desired flow rates, volumes, and/or detergent concentrations to facilitate various operating cycles, e.g., such as wash or rinse cycles.

Although water supply conduit 166, water supply source 170, discharge nozzle 176, and water control valve 172 are all described and illustrated herein in the singular form, it should be appreciated that these terms may be used herein generally to describe a supply plumbing for providing hot and/or cold water into wash chamber 110. In this regard, water supply conduit 166 may include separate conduits for receiving hot and cold water, respectively. Similarly, water supply source 170 may include both hot- and cold-water supplies regulated by dedicated valves. In addition, washing machine appliance 100 may include one or more pressure sensors (not shown) for detecting the amount of water and or clothes within wash tub 108. For example, the pressure sensor may be operably coupled to a side of tub 108 for detecting the weight of wash tub 108, which controller 156 may use to determine a volume of water in wash chamber 110 and a subwasher load weight.

After wash tub 108 is filled and the agitation phase of the wash cycle is completed, wash basket 114 can be drained, e.g., by drain pump assembly 130. Laundry articles can then be rinsed by again adding fluid to wash basket 114 depending on the specifics of the cleaning cycle selected by a user. The impeller or agitation element 132 may again provide agitation within wash basket 114. One or more spin cycles may also be used as part of the cleaning process. In particular, a spin cycle may be applied after the wash cycle and/or after the rinse cycle in order to wring wash fluid from the articles being washed. During a spin cycle, wash basket 114 is rotated at relatively high speeds to help wring fluid from the laundry articles through perforations 126. Additionally, rotation of wash basket 114 may circulate a flow of air within wash tub 108 which, as will be described below, may be facilitated into and out of wash basket 114 by tub cover 200 for reducing remaining moisture content within wash basket 114 and, thus, from the articles being washed. It should be appreciated that the flow of air circulated by rotation of wash basket 114 may be ambient air circulated by rotational motion of wash basket 114 and not air generated and directed into washing machine appliance 100, such as by a blower, fan, or other air injecting device. As such, washing machine appliance 100 may not include a blower, fan, or any other air injecting device for directing a flow of air into washing machine appliance 100. During or prior to the spin cycle, drain pump assembly 138 may operate to discharge wash fluid from wash tub 108, e.g., to an external drain. After articles disposed in wash basket 114 are cleaned and/or washed, the user can remove the articles from wash basket 114, e.g., by reaching into wash basket 114 through opening 116.

Referring still to FIG. 1, a schematic diagram of an external communication system 190 will be described according to an exemplary embodiment of the present subject matter. In general, external communication system 190 is configured for permitting interaction, data transfer, and other communications between washing machine appliance 100 and one or more external devices. For example, this communication may be used to provide and receive operating parameters, user instructions or notifications, performance characteristics, user preferences, or any other suitable information for improved performance of washing machine appliance 100. In addition, it should be appreciated that external communication system 190 may be used to transfer data or other information to improve performance of one or more external devices or appliances and/or improve user interaction with such devices.

For example, external communication system 190 permits controller 156 of washing machine appliance 100 to communicate with a separate device external to washing machine appliance 100, referred to generally herein as an external device 192. As described in more detail below, these communications may be facilitated using a wired or wireless connection, such as via a network 194. In general, external device 192 may be any suitable device separate from washing machine appliance 100 that is configured to provide and/or receive communications, information, data, or commands from a user. In this regard, external device 192 may be, for example, a personal phone, a smartphone, a tablet, a laptop or personal computer, a wearable device, a smart home system, or another mobile or remote device.

In addition, a remote server 196 may be in communication with washing machine appliance 100 and/or external device 192 through network 194. In this regard, for example, remote server 196 may be a cloud-based server 196, and is thus located at a distant location, such as in a separate state, country, etc. According to an exemplary embodiment, external device 192 may communicate with a remote server 196 over network 194, such as the Internet, to transmit/receive data or information, provide user inputs, receive user notifications or instructions, interact with or control washing machine appliance 100, etc. In addition, external device 192 and remote server 196 may communicate with washing machine appliance 100 to communicate similar information.

In general, communication between washing machine appliance 100, external device 192, remote server 196, and/or other user devices or appliances may be carried using any type of wired or wireless connection and using any suitable type of communication network, non-limiting examples of which are provided below. For example, external device 192 may be in direct or indirect communication with washing machine appliance 100 through any suitable wired or wireless communication connections or interfaces, such as network 194. For example, network 194 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 190 is described herein according to an exemplary embodiment of the present subject matter. However, it should be appreciated that the exemplary functions and configurations of external communication system 190 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

While described in the context of a specific embodiment of vertical axis washing machine appliance 100, using the teachings disclosed herein it will be understood that vertical axis washing machine appliance 100 is provided by way of example only. Other washing machine appliances having different configurations, different appearances, and/or different features may also be utilized with the present subject matter as well, e.g., horizontal axis washing machine appliances. In addition, aspects of the present subject matter may be utilized in a combination washer/dryer appliance.

Referring now generally to FIGS. 4 through 7, washing machine appliance 100 may further include a tub cover 200 that is generally positioned over wash tub 108 and/or wash basket 114. In this regard, tub cover 200 may be positioned over a balancing ring 202 that is mounted directly over top of wash basket 114. In general, tub cover 200 may be configured to reduce splashing out of wash tub 108. For example, tub cover 200 may include a main body 210 that defines a receiving slot 212 that may be configured for receiving a top end of the balancing ring 202 or wash basket 114. Similarly, a top end of wash tub 108 (not shown in FIGS. 4 and 5) may also be received within receiving slot 212. In general, tub cover 200 does not rotate with wash basket 114 but is instead rotatably fixed or stationary relative to wash tub 108 and/or cabinet 102.

In this regard, as illustrated in FIGS. 4 through 7, tub cover 200 may generally define a radial direction R and a circumferential direction C. In addition, main body 210 of tub cover 200 may include an edge 214 generally defining a perimeter 220 (e.g., an outermost surface of main body 210 along the radial direction R) of main body 210. Accordingly, tub cover 200 may further include a plurality of bumpers 250 that are mounted to perimeter 220 of tub cover 200 to absorb impacts between tub cover 200 and cabinet 102.

It should be appreciated that various features of tub cover 200 may be formed from any suitably rigid material. For example, according to exemplary embodiments, main body 210 and bumpers 250 may be formed by injection molding, e.g., using a suitable plastic material, such as injection molding grade Polybutylene Terephthalate (PBT), Nylon 6, high impact polystyrene (HIPS), acrylonitrile butadiene styrene (ABS), or any other suitable blend of polymers. In this regard, main body 210 and bumpers 250 may be integrally molded as a single, unitary piece. Alternatively, according to the exemplary embodiment, these components may be compression molded, e.g., using sheet molding compound (SMC) thermoset plastic or other thermoplastics. According to still other embodiments, portions of tub cover 200 may be formed from any other suitable rigid material.

Once the wash cycle is complete, remaining moisture content, which includes water and moisture not removed during the wash cycle, may remain on the articles and within wash baskets of washing machine appliances. Accordingly, aspects of the present subject matter are directed to structures for reducing the negative effects of such impacts. The remaining moisture content may lead to energy inefficiencies of washing machine appliances. For example, washing machine appliances may require more energy/power to rotate the wash baskets during a spin cycle the higher the remaining moisture content. Accordingly, aspects of the present subject matter are directed to structures for reducing the remaining moisture content in the articles and within wash baskets of washing machine appliances.

According to example embodiments, main body 210 of tub cover 200 may include a top surface 216. A top surface diameter TSD of top surface 216 may be smaller than a perimeter diameter PD of perimeter 220 (e.g., diameter of outermost surface of main body 210). As such, the top surface 216 may be positioned inside of perimeter diameter PD of perimeter 220. Additionally, top surface 216 may be positioned above the edge 214 in vertical direction V.

Furthermore, main body 210 may include a sloped surface 218 connecting top surface 216 to edge 214. Sloped surface 218 may define a slope that declines as the sloped surface 218 extends from top surface 216 to edge 214.

Figure 6:
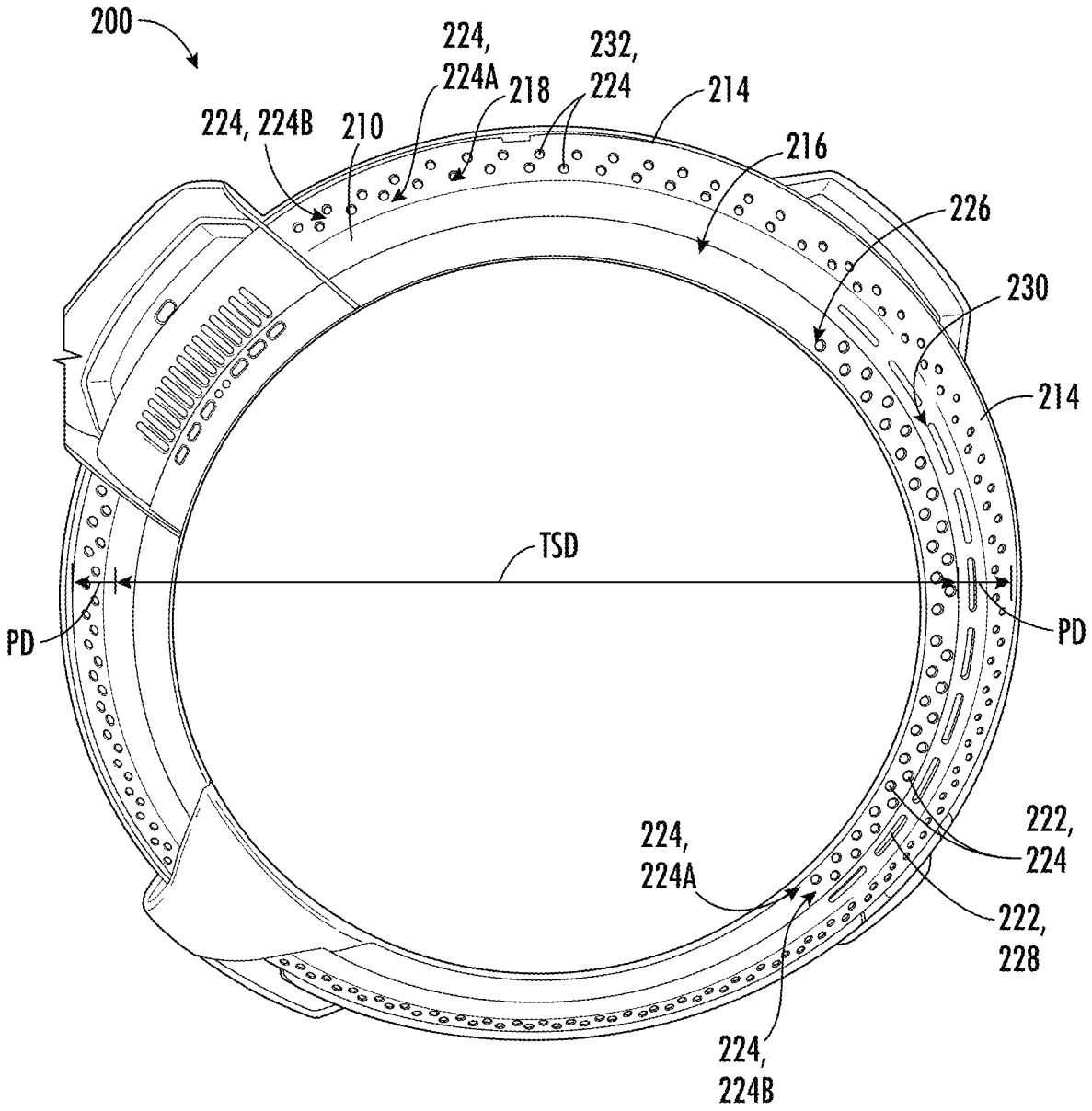
FIG. 6 provides a top view of a tub cover of the exemplary tub assembly of FIG. 5 in accordance with one embodiment of the present disclosure.

According to example embodiments, a plurality of top surface openings 222 are defined through top surface 216 of main body 210. Top surface openings 222 may take various forms and be positioned in various locations along top surface 216. For example, as best illustrated in FIG. 6, top surface openings 222 may include a plurality of circular holes 224 arranged along a portion of top surface 216. The circular holes 224 may be arranged in multiple circumferential rows along a circumference of an inner portion 226 of top surface 216. For example, as shown in FIG. 6, a first row of circular holes 224A may be circumferentially aligned/aligned with each other along the circumference of the inner portion 226 of top surface 216. Additionally, a second row of circular holes 224B may be radially offset/radially spaced apart from the first row of circular holes 224A and circumferentially aligned with each other along the circumference of the inner portion 226 of the top surface 216.

Furthermore, as best illustrated in FIG. 6, top surface openings 222 may include a plurality of rectangular holes with rounded ends 228 arranged along a portion of top surface 216. The rectangular holes with rounded ends 228 may be arranged in a single circumferential row along a circumference of an outer portion 230 of top surface 216 and may be circumferentially aligned with each other.

Figure 7:
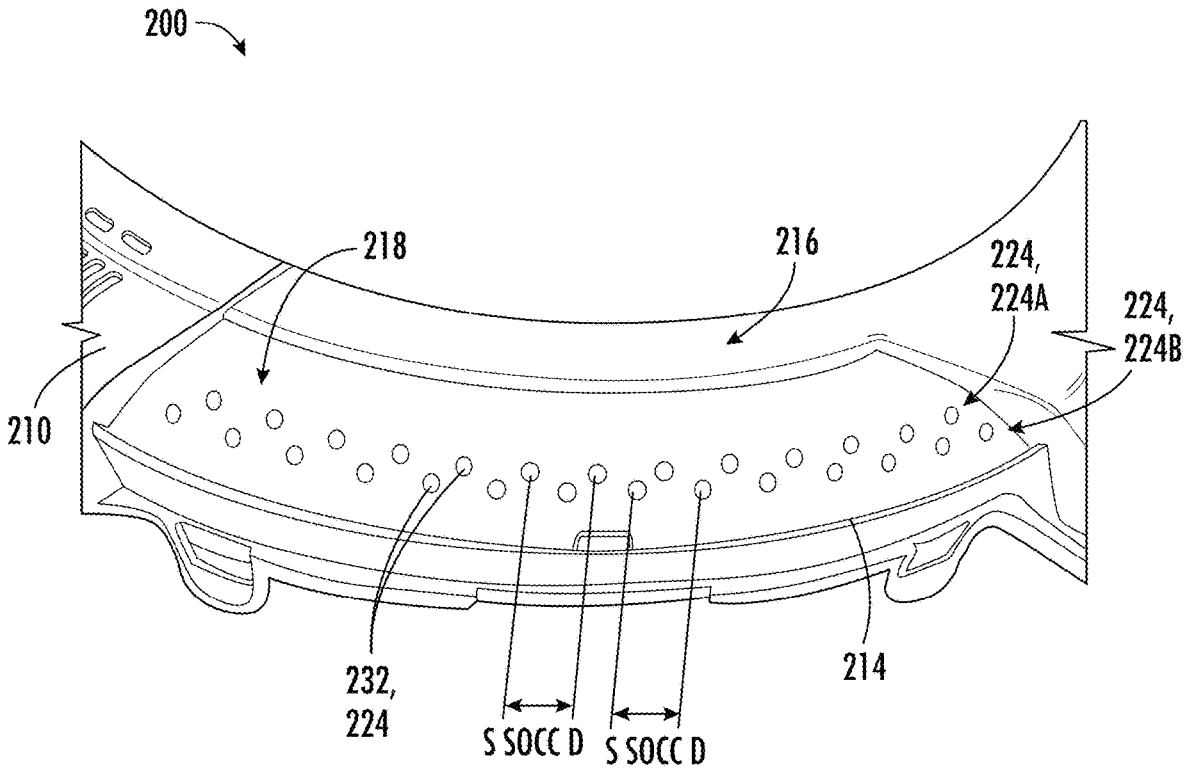
FIG. 7 provides a close-up perspective view of the exemplary tub cover of FIG. 6 in accordance with one embodiment of the present disclosure.

According to example embodiments, a plurality of sloped surface openings 232 are defined through sloped surface 218 of main body 210. The sloped surface openings 232 may facilitate a flow of air through wash basket 114. For example, rotation of wash basket 114 within wash tub 108, such as during a spin cycle, may circulate a flow of air within wash tub 108. Additionally, such circulated air may be external air that enters washing machine appliance 100 through, for example, gaps between door 120 and top panel 118 of washing machine appliance 100 when door 120 is in the closed position during rotation of wash basket 114 or when wash basket 114 is not rotating. The flow of air circulated by rotation of wash basket 114 is facilitated into and out of wash basket 114 through sloped surface openings 232 which decreases the amount of remaining moisture content in the articles and within wash basket 114. For example, as best illustrated in FIGS. 6 and 7, sloped surface openings 232 may include a plurality of circular holes 224 arranged along sloped surface 218. The circular holes 224 may be arranged in multiple circumferential rows along a circumference of sloped surface 218. For example, as shown in FIGS. 6 and 7, a first row of circular holes 224A may be circumferentially aligned/aligned with each other along the circumference of the sloped surface 218. Additionally, a second row of circular holes 224B may be radially offset/radially spaced apart from the first row of circular holes 224A and circumferentially aligned with each other along the circumference of sloped surface 218. As shown in FIGS. 6 and 7, the first row of circular holes 224A may be positioned closer to top surface 216 than the second row of circular holes 224B, while the second row of circular holes 224B may be positioned closer to edge 214 than the first row of circular holes 224A.

Figure 8:
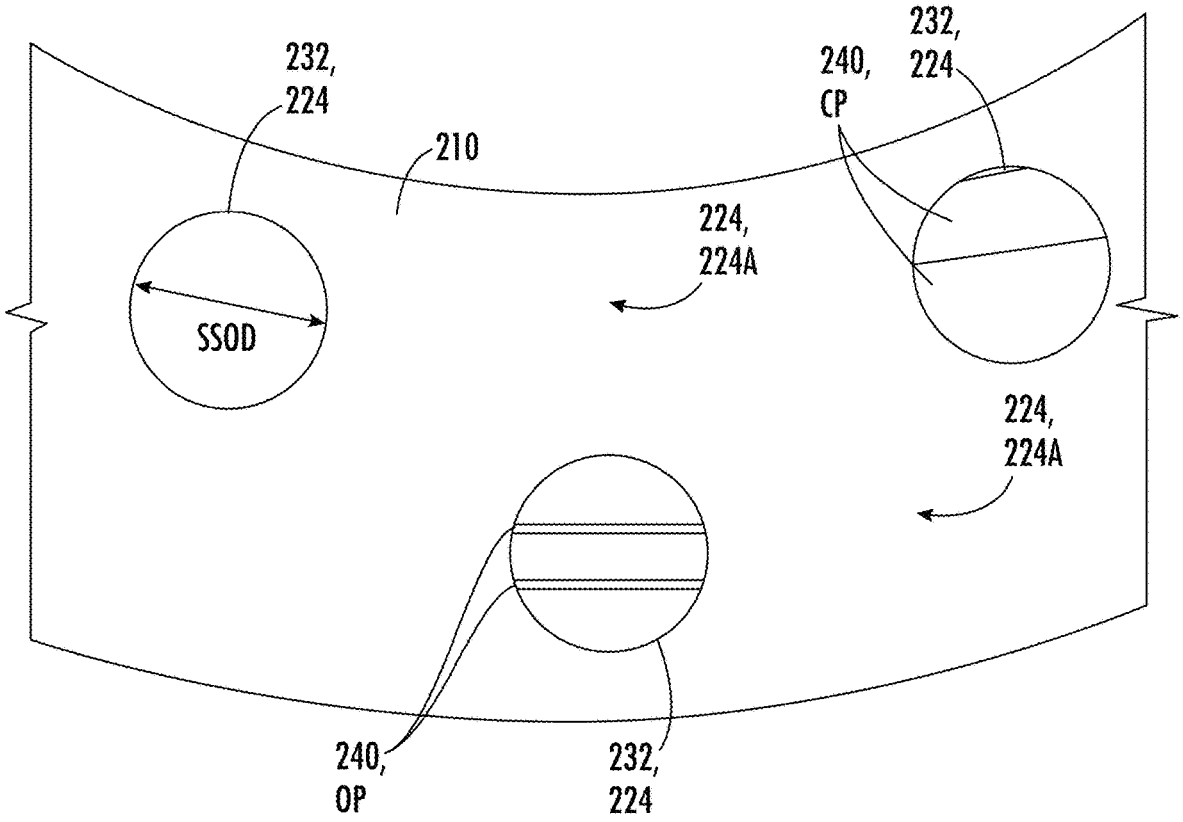
FIG. 8 provides a close-up top view of the exemplary tub cover of FIG. 6 in accordance with on embodiment of the present disclosure.

According to example embodiments, the plurality of circular holes 224 defined through sloped surface 218 of main body 210 may each define geometrical parameters. For example, as best illustrated in FIG. 8, each circular hole 224 defined through sloped surface 218 defines a sloped surface opening diameter SSOD of about 0.2 inches. Furthermore, in some embodiments, the total area of circular holes 224 (i.e., area of all circular holes 224 defined through sloped surface 218) is about 4.71 inches. Additionally, as best illustrated in FIG. 7, in some embodiments, the circular holes 224 for each row (e.g., the first row 224A) defined through sloped surface 218 may be circumferentially aligned along the circumference of sloped surface 218. The sloped surface opening center-to-center distance SSOCCD between each adjacent pair of circumferentially aligned circular holes 224 defined through sloped surface 218 is about 0.8 inches. Moreover, in some embodiments, a quantity of about 150 circular holes 224 are defined through sloped surface 218.

According to example embodiments, one or more adjustable vents 240 (FIG. 8) may be positioned within each of the circular holes 224 defined through sloped surface 218 of main body 210. For example, vents 240 may be adjustable between open position OP in which the flow of air passes through the circular holes 224 defined through sloped surface 218 and closed position CP in which the flow of air is inhibited from passing through the circular holes 224 defined through sloped surface 218. The vents may be adjusted electronically (e.g., via one or more controllers) or may be adjusted manually (e.g., air flow is powerful enough to move vents 240 from closed to open position).

As explained herein, aspects of the present subject matter are generally directed to a top load washing machine tub cover with airflow openings for reducing the amount of remaining moisture content within the articles and the wash basket. For example, a plurality of sloped surface openings are defined through a sloped surface of the tub cover. The sloped surface openings may be sized, arranged, etc. to promote increased airflow into and out of the wash basket to reduce the amount of remaining moisture content. Reduction of remaining moisture content may lead to less energy utilized by the washing machine appliance, such as during the spin cycle, and, thus, lead to lower energy costs.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:

a cabinet;

a wash tub positioned within the cabinet;

a wash basket rotatably mounted within the wash tub and defining a wash chamber configured for receiving a load of clothes; and a tub cover positioned over the wash tub, the tub cover comprising:

a main body including an edge defining a perimeter of the main body, the main body further including a top surface and a sloped surface connecting the top surface and the edge and defining a slope;

wherein:

rotation of the wash basket within the wash tub circulates a flow of air within the wash tub;

a plurality of top surface openings are defined through the top surface of the main body of the tub cover; and a plurality of sloped surface openings are defined through the sloped surface of the main body of the tub cover for facilitating the flow of air circulated by rotation of the wash basket into and out of the wash basket.

2. The washing machine appliance of claim 1, wherein the washing machine appliance does not include a blower for directing a flow of air into the washing machine appliance.

3. The washing machine appliance of claim 1, wherein:

one or more vents are positioned within each of the plurality of sloped surface openings and moveable between an open position in which the flow of air passes through the sloped surface openings and a closed position in which the flow of air is inhibited from passing through the sloped surface openings.

4. The washing machine appliance of claim 1, wherein:

the plurality of sloped surface openings are arranged in a plurality of circumferential rows of sloped surface openings.

5. The washing machine appliance of claim 4, wherein, the plurality of circumferential rows of sloped surface openings comprise:

a first row of circumferentially aligned sloped surface openings; and a second row of circumferentially aligned sloped surface openings.

6. The washing machine appliance of claim 5, wherein:

the sloped surface openings of the first row of circumferentially aligned sloped surface openings are arranged along a circumference of the sloped surface and are positioned closer to the top surface than the sloped surface openings of the second row of circumferentially aligned sloped surface openings.

7. The washing machine appliance of claim 5, wherein:

the sloped surface openings of the second row of circumferentially aligned sloped surface openings are arranged along a circumference of the sloped surface and are positioned closer to the edge than the sloped surface openings of the first row of circumferentially aligned sloped surface openings.

8. The washing machine appliance of claim 5, wherein:

the sloped surface openings of the first row of circumferentially aligned sloped surface openings are radially offset from the sloped surface openings of the second row of circumferentially aligned sloped surface openings.

9. The washing machine appliance of claim 1, wherein:

a quantity of about 150 sloped surface openings are defined through the sloped surface of the main body of the tub cover.

10. The washing machine appliance of claim 1, wherein:

each of the plurality of sloped surface openings is a circular hole.

11. The washing machine appliance of claim 10, wherein:

a total area defined by the circular holes is about 4.71 inches.

12. The washing machine appliance of claim 10, wherein:

each circular hole defines a diameter of about 0.2 inches.

13. The washing machine appliance of claim 10, wherein:

at least a portion of the circular holes are aligned along a circumference of the sloped surface; and a center-to-center distance of each adjacent pair of the circumferentially aligned circular holes is about 0.8 inches.

14. A tub cover for a washing machine appliance, the washing machine appliance including a cabinet, a wash tub positioned within the cabinet, and a wash basket rotatably mounted within the wash tub and defining a wash chamber configured for receiving a load of clothes, the tub cover comprising:

a main body including an edge defining a perimeter of the main body, the main body further including a top surface and a sloped surface connecting the top surface and the edge and defining a slope;

wherein:

rotation of the wash basket within the wash tub circulates a flow of air within the wash tub; and a plurality of surface openings are defined through the main body of the tub cover for facilitating the flow of air circulated by rotation of the wash basket into and out of the wash basket.

15. The tub cover of claim 14, wherein:

the plurality of surface openings correspond to a plurality of sloped surface openings defined through the sloped surface of the main body of the tub cover for facilitating the flow of air circulated by rotation of the wash basket into and out of the wash basket; and a plurality of top surface openings are defined through the top surface of the main body of the tub cover.

16. The tub cover of claim 15, wherein:

the plurality of sloped surface openings are arranged in a plurality of circumferential rows of sloped surface openings.

17. The tub cover appliance of claim 16, wherein, the plurality of circumferential rows of sloped surface openings comprise:

a first row of circumferentially aligned sloped surface openings; and a second row of circumferentially aligned sloped surface openings.

18. The tub cover of claim 17, wherein:

the sloped surface openings of the first row of circumferentially aligned sloped surface openings are arranged along a circumference of the sloped surface and are positioned closer to the top surface than the sloped surface openings of the second row of circumferentially aligned sloped surface openings.

19. The tub cover of claim 17, wherein:

the sloped surface openings of the second row of circumferentially aligned sloped surface openings are arranged along a circumference of the sloped surface and are positioned closer to the edge than the sloped surface openings of the first row of circumferentially aligned sloped surface openings.

20. The tub cover of claim 17, wherein:

the sloped surface openings of the first row of circumferentially aligned sloped surface openings are radially offset from the sloped surface openings of the second row of circumferentially aligned sloped surface openings.

* * * * *